US007179157B2

(12) United States Patent
Wheeler et al.

(10) Patent No.: US 7,179,157 B2
(45) Date of Patent: Feb. 20, 2007

(54) BENCH GRINDER

(75) Inventors: Thomas Wheeler, City of Industry, CA (US); Hrayr Darbinyan, Yerevan (AM); Karine Kocharyan, Yerevan (AM)

(73) Assignee: Olympia Group, Inc., City of Industry, CA (US)

( * ) Notice: Subject to any disclaimer, the term of this patent is extended or adjusted under 35 U.S.C. 154(b) by 35 days.

(21) Appl. No.: 10/429,940

(22) Filed: May 2, 2003

(65) Prior Publication Data

US 2004/0229547 A1 Nov. 18, 2004

(51) Int. Cl.
*B24B 41/00* (2006.01)

(52) U.S. Cl. ..... 451/361; 451/28; 451/57; 451/177; 451/178; 451/211; 451/247; 451/291

(58) Field of Classification Search ..... 451/28, 451/57, 177, 178, 211, 247, 291, 361
See application file for complete search history.

(56) References Cited

U.S. PATENT DOCUMENTS 3,643,307 A * 2/1972 Ledergerber et al. ..... 29/38 B
4,227,902 A * 10/1980 Olson ..... 55/302
4,257,194 A * 3/1981 Cailloux ..... 451/163
4,318,432 A 3/1982 Howey
4,321,843 A * 3/1982 Schwab et al. ..... 76/107.4
4,422,265 A 12/1983 Branston
4,568,030 A 2/1986 Weichel
4,794,740 A 1/1989 Keith et al.
5,525,095 A 6/1996 Baughman
6,095,658 A * 8/2000 Kalousis ..... 362/119
6,293,320 B1 9/2001 McGregor, II
6,746,320 B2 * 6/2004 Krusell et al. ..... 451/302
6,769,971 B2 * 8/2004 Gipson ..... 451/178

* cited by examiner

*Primary Examiner*—Lee D. Wilson
*Assistant Examiner*—Shantese McDonald
(74) *Attorney, Agent, or Firm*—Patterson & Sheridan, L.L.P.

(57) ABSTRACT

The present invention discloses a workshop unit for use as a grinding center that includes a support frame having a drive motor and a multi-station tool mounted thereto. Particularly, the grinding center may be used for operations including but not limited to grinding, buffing, polishing, sanding, and cleaning. The multi-station tool includes a plurality of rotary tools, a power transfer system, and a rotary tool selecting system. The power transfer system operates through a plurality of pulleys each in communication with at least one rotary tool and the drive motor through a plurality of transmission links. The rotary tool selecting system, which includes one or more control shafts and a clutch system, allows each tool to be selectively and independently operated. The present invention provides a cost and space saving apparatus in which several tools share expensive components and are arranged within one unit to provide more functionality in less space relative to the same tools purchased and operated individually.

32 Claims, 7 Drawing Sheets

BENCH GRINDER

BACKGROUND OF THE INVENTION

1. Field of the Invention

The present invention relates to a workshop unit that includes a plurality of different tools mounted on a single frame. More specifically, this invention is directed to a center for rotary tools, such as grinding, buffing, polishing, and cleaning wheels. More particularly still, the invention relates to a center for rotary tools, any of which may be selectively operated at any time.

2. Description of the Related Art

Typically, rotary tool workshop units are designed for performing only one particular operation. This conventional design requires an operator to utilize separate workshop units to perform each different operation.

One known workshop grinder is a two wheel bench grinder. Typically such a grinder carries a grinding wheel mounted on one end of a rotating shaft and a buffing brush wheel mounted on the other end of that shaft. The types of wheels that can be mounted on the ends of the shaft vary and are interchangeable on the shaft. The shaft of the bench grinder is a single unit and, therefore, the output ends of the shaft are coupled such that they turn at the same speed when the motor is on. Such a bench grinder is shown in U.S. Pat. No. 5,525,095, which is incorporated in its entirety herein by reference.

In use, the aforementioned two wheel bench grinder must be affixed to some supported flat surface or floor stand and can only operate two wheels at a time. The two wheel bench grinder cannot support continuous operations, which require more than two types of grinding wheels. For example, operations, which require more than two types of grinding wheels, must be interrupted for wheel changes when using the two wheel bench grinder. Further, the two wheel bench grinder is only suited for one user at a time because both wheels are in close proximity to each other and because they are on the same shaft, making the wheels useable from only one side of the grinder.

While there are known different types of rotary tool workshop units, there is not a grinding center that is as versatile as the present invention, which permits a substantial number of different operations to be performed continuously at a central location. A grinding center wherein several tools share expensive components, such as a motor, frame, switches, and housing, can provide a significant cost benefit as opposed to using individual units for each desired operation. In particular, many small establishments with less operating space desire a tool that provides several functions within a relatively small amount of space. In addition, it would be advantageous to be able to operate a desired tool without interference from other tools.

There is a need, therefore, for a more versatile rotary workshop unit that includes a plurality of rotary tools and allows the tools to be utilized selectively.

SUMMARY OF THE INVENTION

The present invention provides a workshop unit that includes a plurality of different tools mounted on a single frame. According to the present invention, any of the tools may be selectively operated at any time. The workshop unit first comprises a support structure. The support structure supports a multi-station tool having a plurality of rotating out-drives. The workshop unit also includes a drive motor supported on the support structure. The drive motor serves to selectively drive the plurality of out-drives.

In one embodiment of the present invention, the multi-station tool comprises a plurality of rotating out-drives and a drive motor. The multi-station tool has a power transfer system to deliver power to the plurality of rotating out-drives. The power transfer system includes a plurality of pulleys, wherein each pulley is disposed on at least one rotating out-drive, and a plurality of transmission links, wherein the plurality of transmission links places each pulley in communication with the drive motor and at least one other pulley. The multi-station tool also includes an out-drive selecting system. The out-drive selecting system includes a plurality of clutches, a plurality of cam followers, one or more control shafts, and a plurality of cams disposed on the one or more control shafts and in communication with the plurality of cam followers. Rotation of the one or more control shafts orients the cams, which serve to pivot one or more of the plurality of cam followers to engage or disengage the plurality of clutches from their respective pulley.

A method for selectively operating a multi-station tool according to one embodiment of the present invention is also provided. The multi-station tool is operated by first providing a first and second rotary out-drive to the multi-station tool, wherein each of the first and second rotary drives is engaged to a first and second clutch, respectively. Rotation of one or more control shafts correspondingly rotates a plurality of cams disposed on the one or more control shafts. The plurality of cams function to selectively pivot a plurality of cam followers in communication with the first and second clutch. The first clutch is then disengaged from the first rotary out-drive. Power is delivered from a drive motor to a plurality of pulleys through a plurality of transmission links to actuate the second out-drive, wherein at least one pulley is in rotational communication with the second out-drive.

BRIEF DESCRIPTION OF THE DRAWINGS

So that the manner in which the above recited features of the present invention are attained and can be understood in detail, a more particular description of the invention, briefly summarized above, may be had by reference to the drawings that follow, i.e., FIGS. 1A–B, 2A–B, 3, 4, 5, 6, and 7. However.

FIGS. 1A–B present schematic views of a rotary tool workshop unit according to one embodiment of the invention.

FIG. 2A shows a partial cross-sectional view of a multi-station tool according to one embodiment of the invention.

FIG. 2B illustrates an adjacent side, partial cross-sectional view of the multi-station tool according to the embodiment of the invention shown in FIG. 2A.

FIG. 3 presents a partial cross-sectional view of a multi-station tool according to another embodiment of the invention.

FIG. 4 shows an adjacent side, partial cross-sectional view of the multi-station tool according to the embodiment of the invention shown in FIG. 3.

FIG. 5 provides a top, partial cross-sectional view of the multi-station tool portion of the grinding center according to one embodiment of the present invention.

FIG. 6 shows a partial cross-sectional view of the invention according to another embodiment.

FIG. 7 provides top schematic view of the rotary shafts 22' and 22" according to yet another embodiment of the present invention.

DETAILED DESCRIPTION OF THE PREFERRED EMBODIMENTS

Figure 1B:
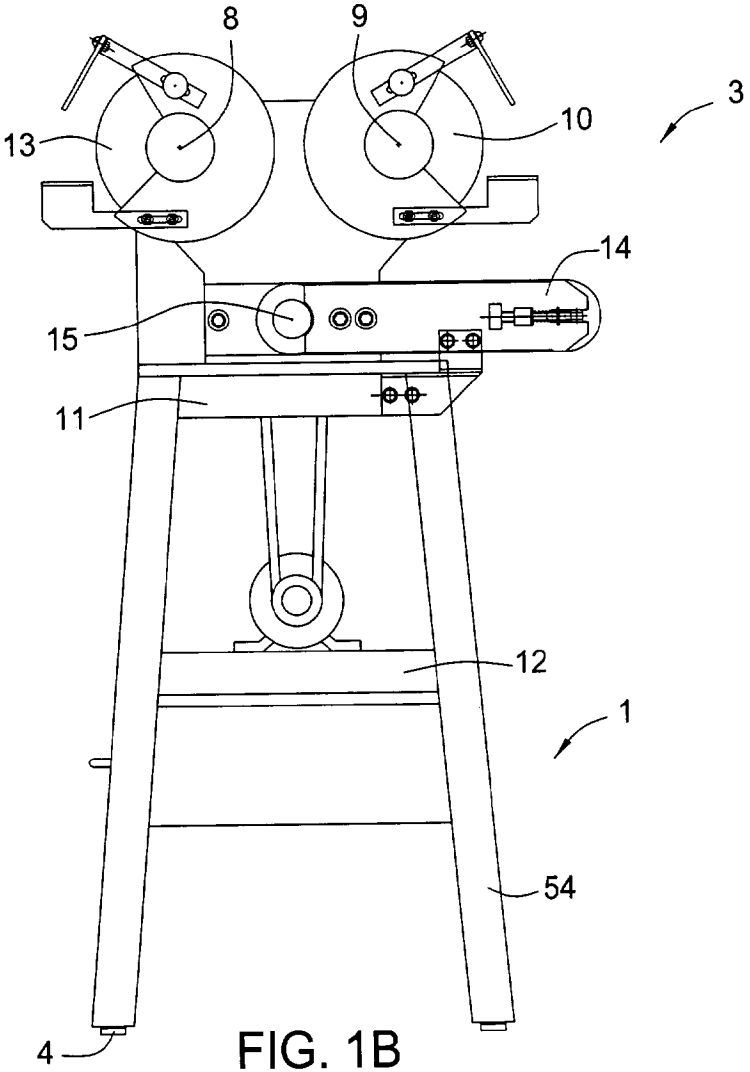
FIGS. 1A–B, 2A–B, 3, 4, 5, 6, and 7 illustrate only selected embodiments of the present invention and are not to be considered limiting of its scope.
Figure 1A:
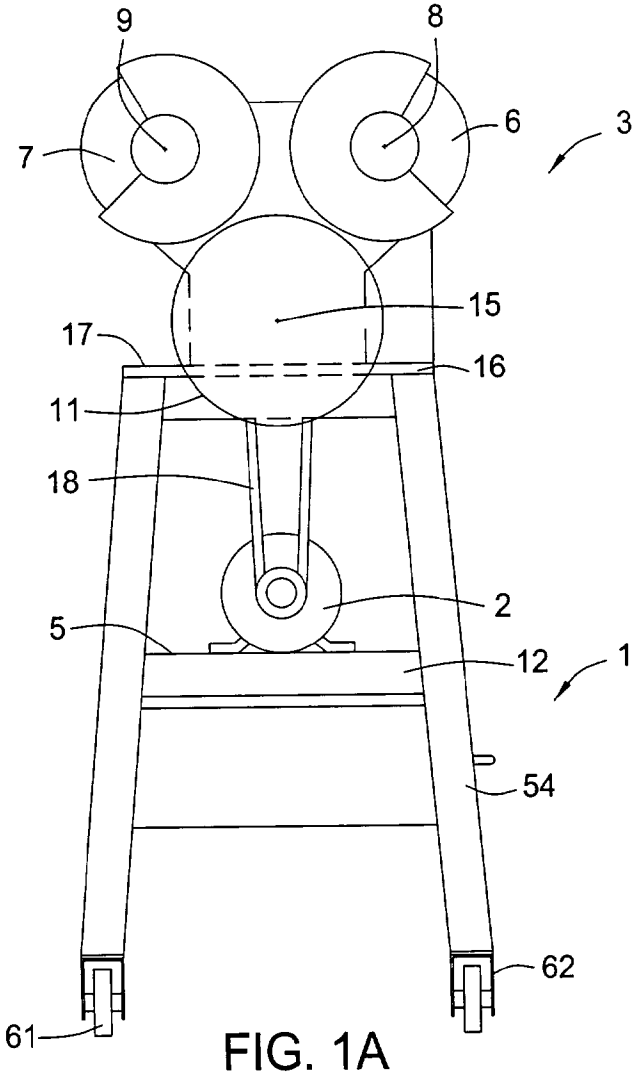

FIGS. 1A and 1B illustrate one embodiment of the rotary tool workshop unit of the present invention. More particularly, FIGS. 1A and 1B show a grinding center from a first side and a second side, respectively. The grinding center first includes a support frame 1 having a drive motor 2 and a multi-station tool 3 mounted thereto.

Referring to FIGS. 1A and 1B, the support frame 1 consists of four vertically extending support members or legs 54, a cross member 12, and a top plate 16. The legs 54 are preferably fabricated from tubing having a square cross section. The cross member 12 may be fabricated from a single plate which has been cut and bent to form an open sided box and that cross member 12 is then attached in a substantially horizontal position between the four legs 54 such that a largest surface 5 of the support member is upwardly facing. Optionally, a sliding tool drawer (not shown) may be positioned within the cross member 12 for storing rotating tools or hand tools. The drive motor 2 is mounted to the largest surface 5 of the cross member 12. Placement of the drive motor 2 below the multi-station tool 3 greatly increases the stability and reduces the vibration of the multi-station tool 3. The top plate 16 may be fabricated in a manner similar to that of the cross member 12. The top plate 16 is attached to the upper ends of the legs 54 and forms an upper surface 17 of the support frame 1. Wheels 61 are fixed to the lower ends of two adjacent legs 54 by any suitable means, and adjustable pads 4 are fixed to the lower ends of the other two adjacent legs 54. That arrangement allows a user to selectively relocate the grinding center by tilting it such that the pads 4 are removed from frictional contact with a surface on which the grinding center rests and then rolling the wheels 61 along that surface thereby moving the grinding center. When the grinding center has been rolled to a desired location, it can be set down such that the pads 4 are in frictional contact with the surface beneath the grinding center thereby fixing the grinding center at the desired location.

The multi-station tool 3 is mounted on the upper surface 17 of the support frame 1 and includes three rotary tool stations facing the first side of the grinding station and three other rotary tool stations facing the second side of the grinding station. The multi-station tool 3 receives power from the drive motor 2 via a drive link 18. The drive link 18 is typically a v-belt but may be any suitable power transmission means.

FIG. 1A is a schematic view of the first side of the grinding station. The three rotary tool stations facing that side are shown to be equipped with rotating disk tools 7, 6, and 11, where those tools rotate on shafts or out-drives having axes 9, 8, and 15 respectively. FIG. 1B shows the second side of the grinding station. The three rotary tool stations facing that side are shown to be equipped with rotating disk tools 13 and 10 and belt sander 14, where those tools rotate on shafts having axes 8, 9, and 15, respectively. The rotating disk tools may be any suitable disk tools such as grinders, buffers, polishers and the like. The belt sander 14 may also be any other suitable continuous belt or band tool or a flexible out-drive extension shaft for transmitting out-drive power to a location removed from the grinding center. Furthermore, any of the rotary tool stations may be equipped with any of the aforementioned tools or extensions or any other suitable rotary driven tool.

Figure 2B:
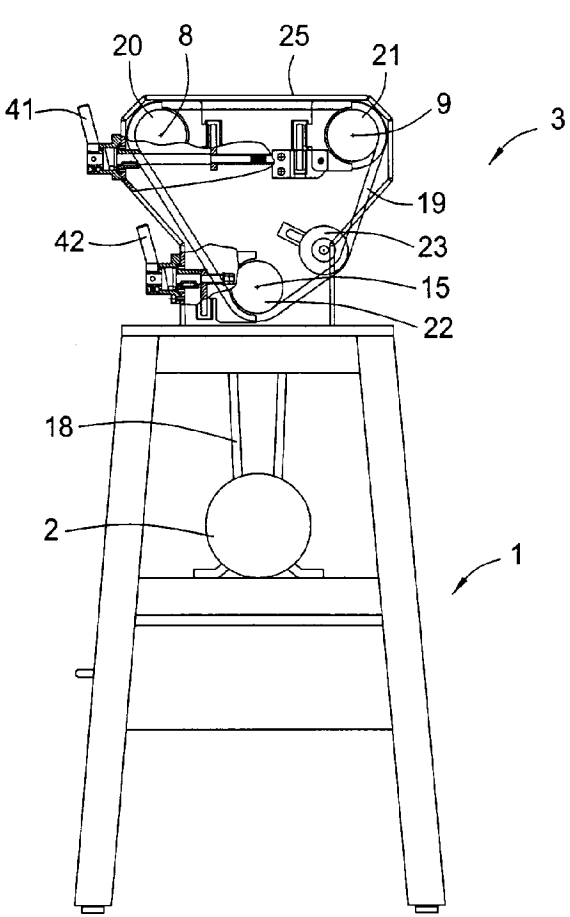
Figure 2A:
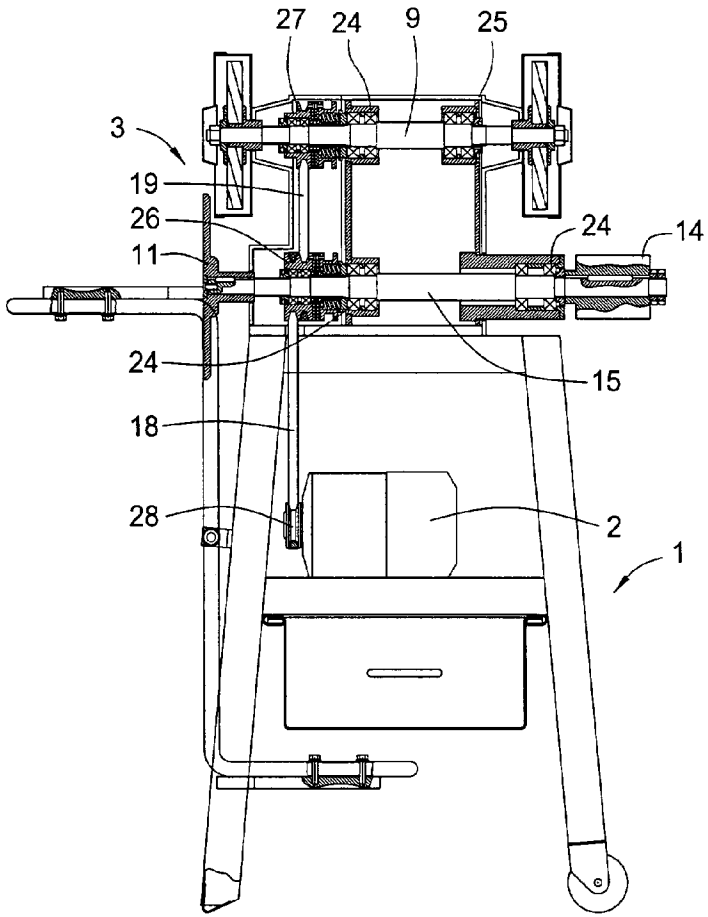

FIG. 2A illustrates a partial cross-sectional view of the internal power transfer system or transmission system of the multi-station tool 3 according to one embodiment of the present invention. A double v-belt pulley 26 is concentrically affixed to the shaft having axis 15, and single v-belt pulleys 34 (not shown) and 27 are concentrically affixed to the shafts having axes 8 and 9, respectively. The diameter of each pulley 26, 27, and 34 can be individually designed so that their respective shaft rotates at an optimal speed for their particular application. The drive link 18 is moved by a v-belt pulley 28 affixed to the output shaft of drive motor 2. The drive link 18 transmits power from the drive motor 2 to the shaft 15 through the double v-belt pulley 26. A transmission link 19 connects the shafts having axes 8, 9 and 15 through their respective pulleys. The transmission link 19 is moved by the double v-belt pulley 26 and thereby transmits power to the shafts having axes 8 and 9 via single v-belt pulleys 34 and 27, respectively. Shafts having axes 8, 9 and 15 are supported by a plurality of bearings 24 contained within the housing 25.

FIG. 2B shows an adjacent side, partial cross-sectional view of the grinding center with the multi-station tool 3 according to the embodiment of the invention illustrated in FIG. 2A. In the perspective of FIG. 2B, the transmission link 19 is shown in communication with three shafts 20, 21, and 22 disposed on axes 8, 9, and 15, respectively. The tension on the transmission link 19 is maintained at a desired level by an idler pulley 23. The desired tension in transmission link 19 and therefore the corresponding percentage of power transmitted to the shafts 20 and 21 from the double v-belt pulley 26 is adjustable by altering the interference of idler pulley 23 in the path of transmission link 19. As shown in FIG. 2B, the multi-station tool 3 has a rotary shaft or tool selection system that includes multiple control members, 41 and 42, which act to engage or disengage a respective clutch thereby activating or deactivating the desired shaft. The control members 41 and 42 shown as hand levers in FIG. 2B may also be dials or any other control member known by a person of ordinary skill in the art. A third control member (not shown) is hidden by control member 41 in the view of FIG. 2B. In this particular embodiment, each control member controls only one clutch, thereby actuating the rotation of only one shaft. In this particular embodiment of the invention, both rotary tools disposed on each shaft 20, 21, and 22 operate dependently and therefore, upon actuation of the desired shaft both tools in communication with the desired shaft will be actuated. However, each shaft 20, 21, and 22 can be split into two independent shafts and a double clutch system can be utilized to independently operate each rotary tool.

In one embodiment of the invention, the clutches may be designed to disengage or slip at a predetermined torque that is below the torque level that will cause the motor to burn out or stall. However, it may be desirable depending on the particular use of the grinding center to configure the clutches to disengage or slip at a torque above the torque level that will cause the motor to burn out or stall. This will allow the maximum possible torque output of the motor to be delivered to the rotary shafts.

As an added safety feature, micro switches (not shown) may be incorporated within the control member and clutch assemblies to prevent the motor 2 from being actuated in the event that more than one clutch has been placed in an actuated position. The micro switches decrease the likelihood of motor overload due to more than one shaft being operated concurrently.

Figure 3:
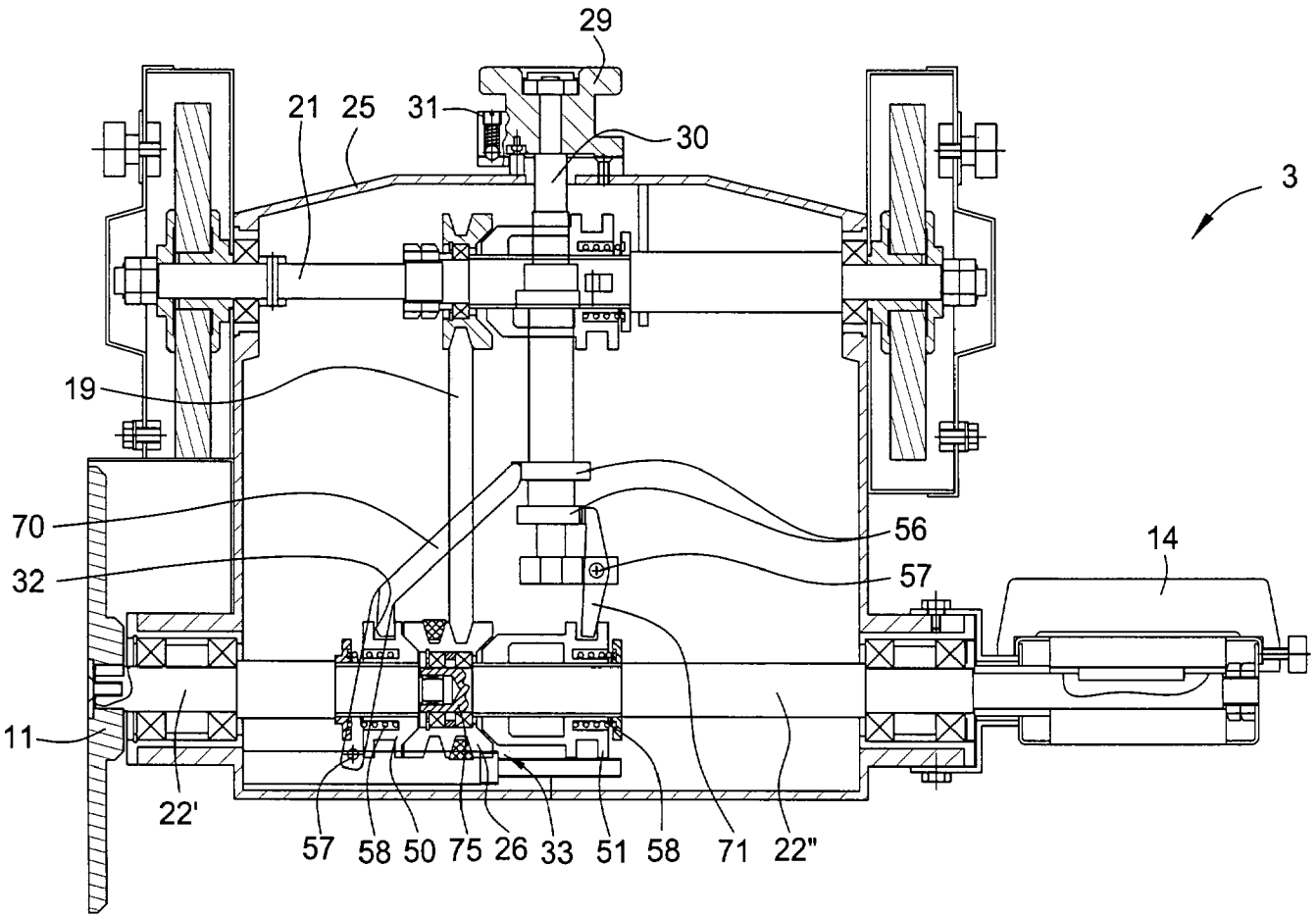
Figure 4:
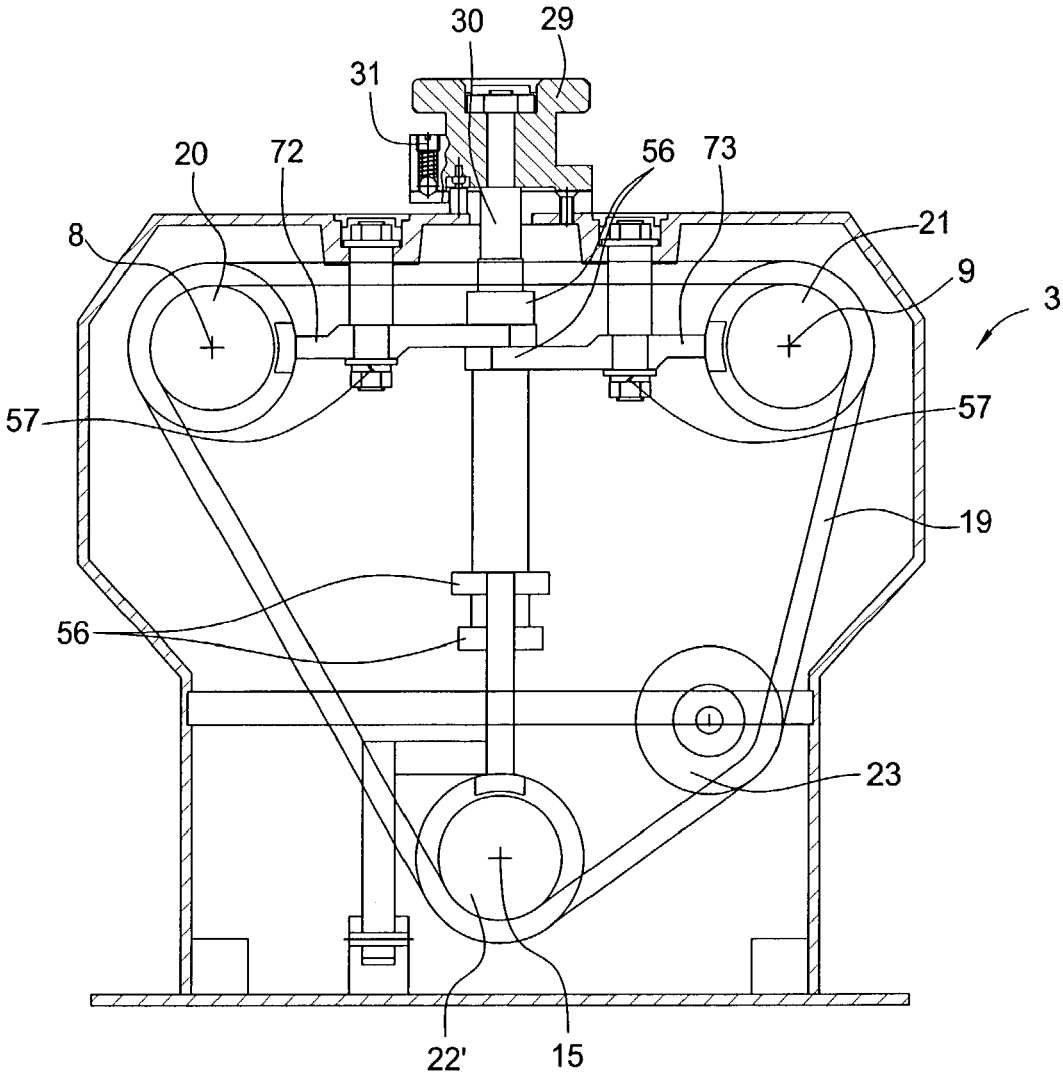
Figure 5:
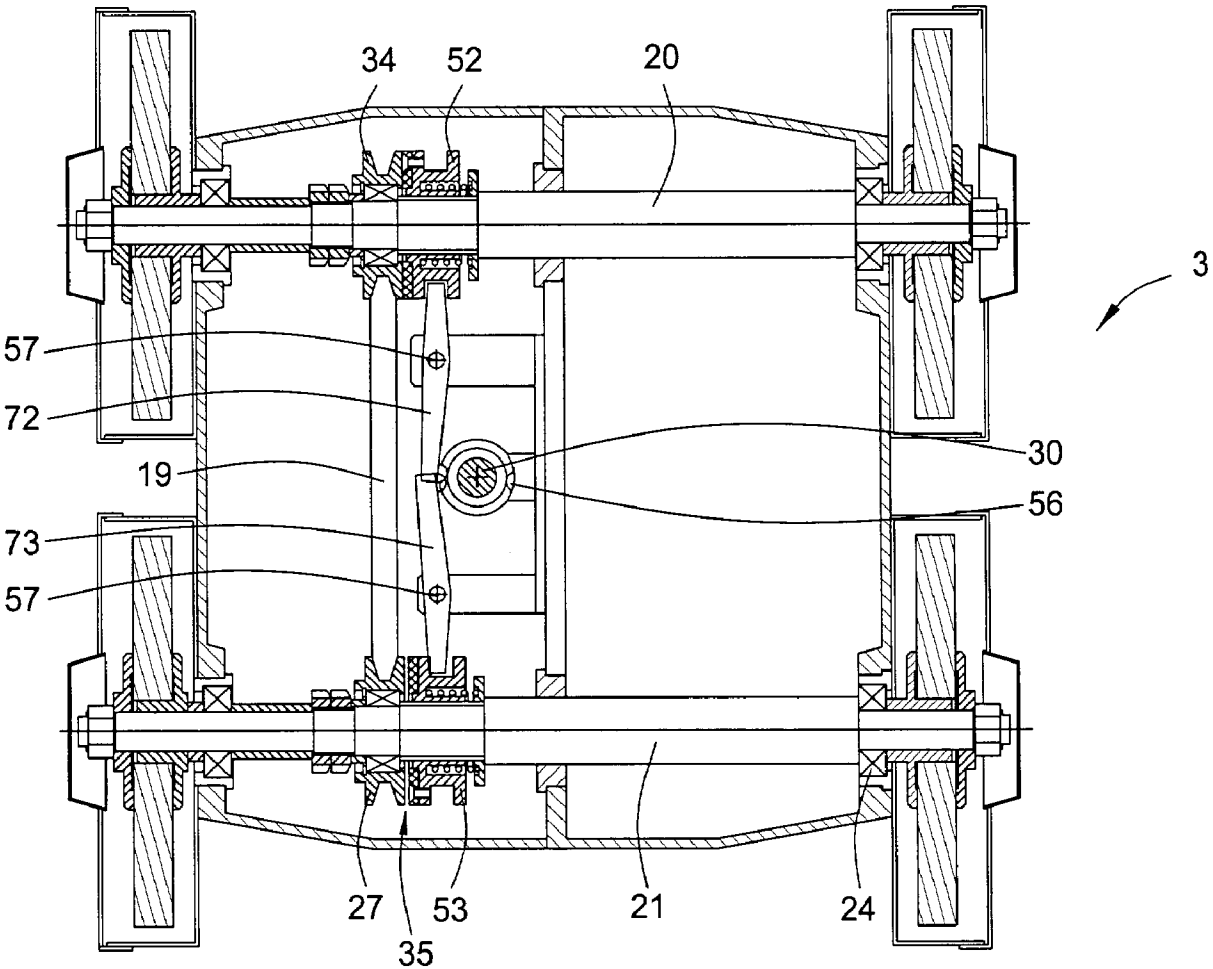

FIGS. 3–5 illustrate another embodiment of the present invention. FIG. 3 illustrates a partial cross-sectional view of the rotary shaft or tool selection system of the multi-station tool 3. As shown in FIG. 3, only one control member 29 is provided to operate a centrally disposed control shaft 30. Although in FIG. 3, the control member 29 shown is a dial, it is understood that the control member 29 could also be a lever or any other type of control member known by a person of ordinary skill in the art. The control shaft 30 includes a plurality of cams 56 disposed along the length of the shaft 30. Each cam 56 interacts with a unique cam follower 70, 71, 72 or 73 as presented in FIG. 3. Cam followers 72 and 73, which interact with the clutch systems that control the upper shafts 20 and 21, respectively, are not shown in the perspective of FIG. 3 and will be shown and described in more detail with reference to FIG. 5. The control member 29 and control shaft 30 may be designed such that the control member 29 will include a directional marking oriented towards the tool or shaft desired for activation. In another embodiment, the control member 29 can be in the form of a lever and extend in the direction of the tool or shaft desired for activation. Positioning the control member 29 at the top of the housing 25 allows for easy access by the operator from all sides of grinding center.

Referring again to FIG. 3, the lower rotating shaft is manufactured from two independent shafts 22' and 22", wherein each shaft 22' and 22" can rotate independently from each other, thereby allowing the tools disposed on the axis 15 to operate independently from each other. The double v-belt pulley 26 is disposed around a junction 75 where the shafts 22' and 22" are joined together. The double v-belt pulley 26 is positioned between two clutches 50 and 51. The clutches 50 and 51 are normally biased in an engaged position against the junction 75 and thereby against the double v-belt pulley 26 by the use of one or more compression springs 58. By rotating the control member 29 the cams 56 positioned on the control shaft 30 can be oriented to disengage or engage the clutches 50, 51, 52, and 53.

As shown in FIG. 3, the clutch 51 is disengaged from the double v-belt pulley 26 as evident by the gap 33 between the clutch 51 and the double v-belt pulley 26. In this position, the cam follower 71 pushes the clutch 51 away from the pulley 26 thereby disengaging it and preventing rotation of the shaft 22". On the opposite side of the pulley 26, the clutch 50 is in an engaged position with the junction 75 and the double v-belt pulley 26. Since the cam follower's 70 respective cam 56 is not oriented in a position to angle the cam follower 70 against the clutch face 32, the clutch is maintained in an engaged position by the bias imparted on the clutch 50 by the spring 58. The clutch faces can be substantially planar, as shown for simplicity, or cone shaped. A cone shaped clutch face design will create a greater clutch face interface force as a result of the axial spring force between the clutch members. A large enough clutch interface force will alleviate the need for a high friction material at the clutch interface. Therefore, using cone shaped clutches can potentially reduce the number of parts required and hence the manufacturing cost and complexity.

The control shaft 30 and the cams 56 can be designed to allow several tools to operate simultaneously or to allow only one tool to be operated at a time. As previously mentioned, allowing only one tool to operate at a time will minimize the possibility of motor overload and will also make the tool safer to use by preventing the unexpected actuation of a tool or tools that are not desired for use at that particular time. Conversely, the multi-station tool 3 can be designed for the use of multiple rotary tools simultaneously. This design may be desirable in a production or manufacturing environment where several operators are using the same multi-station tool. Accordingly, the motor 2 can be designed to handle a greater load resulting from the concurrent use of several rotary tools.

As illustrated in FIG. 3, the control member 29 includes a spring-loaded ball 31. When an adequate axial force is conveyed to the control member 29, the ball 31 will disengage from a groove located on the housing 25. The control member 29 can then be rotated to the desired position wherein the ball will engage another groove provided on the housing 25. The spring-loaded ball 31 allows the control member 29 to remain in the desired location during operation of the multi-station tool 3. In addition, the spring-loaded ball prevents the inadvertent actuation of other tools during operation. In another embodiment of the invention, a mechanical linkage (not shown) interconnects the control shaft 30 or the control member 29 to the master power switch (not shown). Once the clutch corresponding to the selected tool or shaft is actuated and the master power switch is turned on, the mechanical linkage will move into a locking engagement with the control shaft 30 or the control member 29 to prevent the control shaft 30 or the control member 29 from rotating. This locking engagement will prevent the clutches from being coupled or decoupled during operation, which will minimize clutch wear due to clutch faces coming into contact with each other under differential rotary speeds.

FIG. 4 illustrates an adjacent side, partial cross-sectional view of the multi-station tool 3 according to the embodiment of the invention shown in FIG. 3. The perspective of the multi-station tool 3 in FIG. 4 is similar to that of FIG. 2B. However, as described with relation to FIG. 3, in this particular embodiment of the present invention, only one control shaft 30 is necessary to actuate the desired rotary tool or tools. The transmission link 19 is shown in communication with three shafts 20, 21, and 22', recalling that shaft 22" (not shown in this perspective) shares the same axis 15 as shaft 22'. As in FIG. 2B, the tension on the transmission link 19 is maintained at a desired level by an idler pulley 23.

FIG. 5 is a top, partial cross-sectional view of the multi-station tool 3 portion of the grinding center according to one embodiment of the present invention. FIG. 5 illustrates a clutch system that includes clutches 52 and 53 and their respective cam followers 72 and 73. The transmission link 19 is shown to extend between the two top single v-belt pulleys 34 and 27. As similarly described with respect to FIG. 3, the control shaft includes a plurality of cams 56, which are oriented to interact with the top cam followers 72 and 73. In FIG. 5, the clutch 53 has been disengaged by cam follower 73 as evident by the gap 35 between the single v-belt pulley 27 and the clutch 53. Once the clutch 53 has been disengaged, rotational force cannot be transferred to the shaft 21 from the pulley 27. The clutch 52 is shown in an engaged position wherein the shaft 20 is in rotational communication with the single v-belt pulley 34. The shafts 20 and 21 may each be split in two parts as in shafts 22' and 22". This would allow independent control of the tools on either side of the shafts 20 and 21. Accordingly, the addition of two cam followers and a double clutch system would be required for the tools on either shaft 20 or 21 to operate independently from each other under this design.

In one embodiment of the invention, the motor 2 is designed to vary its rotational direction based on which tool or shaft is activated. For example, the rotary tools on each shaft are typically designed to rotate towards their respective worktable. Accordingly, the direction of rotation of the shaft 20 will be opposite to that of shaft 21. A switch system (not shown) is added to the control shaft 30 to communicate to the motor 2 the proper axial direction for rotation depending on which shaft is activated. Furthermore, if the control member is positioned in an intermediate location where no clutch is coupled, the switch system will prevent the motor from rotating. This design will ensure that a clutch is engaged before the motor is actuated thereby preventing clutch wear resulting from contact of the clutch faces under differential rotary speeds.

Figure 6:
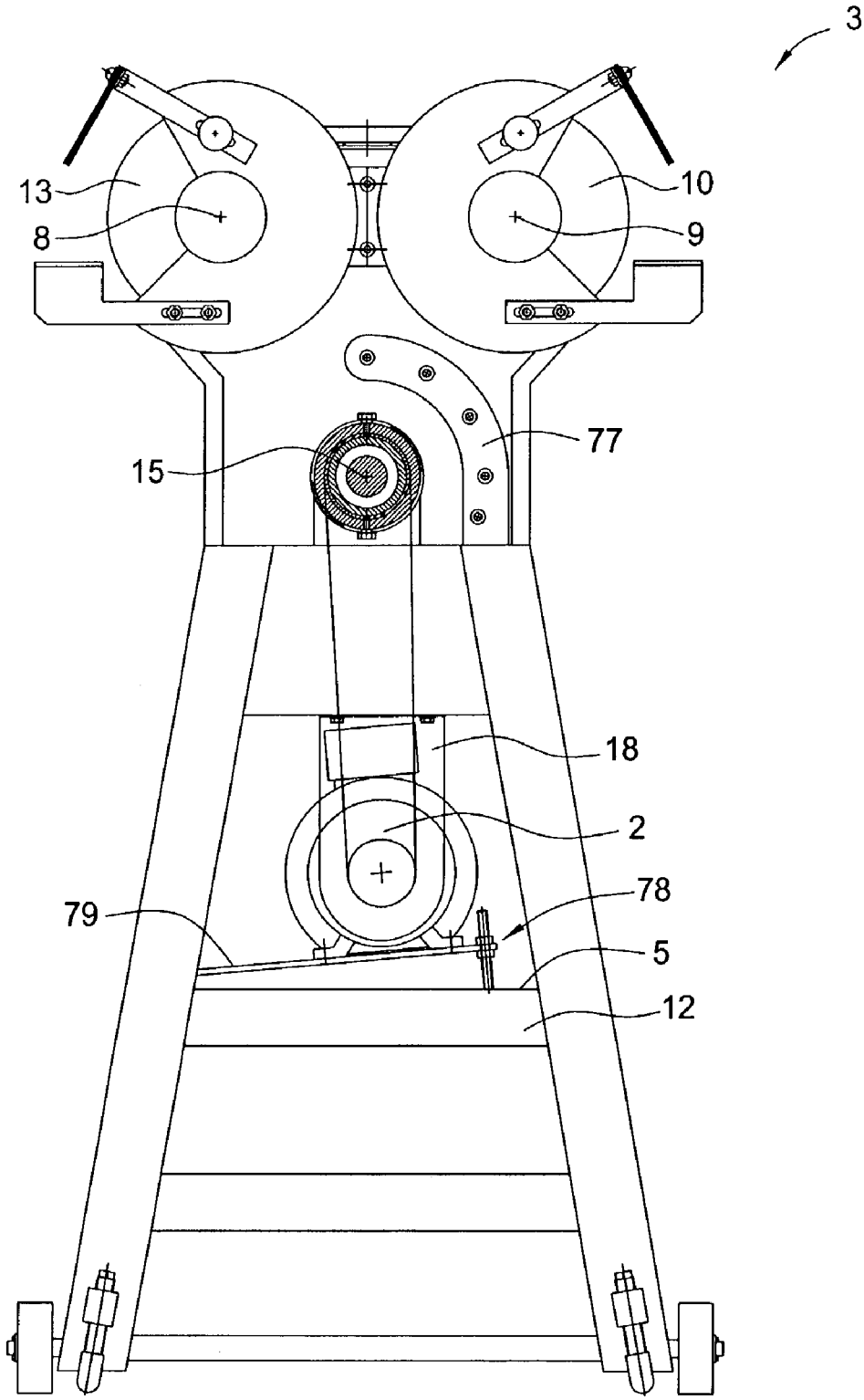

FIG. 6 is a partial cross-sectional view of the invention according to another embodiment. As shown in FIG. 6, a positioning device 77 is located adjacent to the lower axis 15. The positioning device 77 is used to place the belt sander 14 in varying angular positions. The belt sander 14 will temporarily lock in to place at a desired location on the positioning device 77 so as to facilitate the operation of the belt sander 14 at varying angular positions. FIG. 6 also illustrates the drive motor 2 disposed on an angled planar surface 79. The surface 79 includes an elevation mechanism 78 disposed at one end. The elevation mechanism 78 serves to raise or lower the drive motor 2 thereby allowing the tension in the transmission link 18 to be decreased or increased as desired by the operator.

Figure 7:
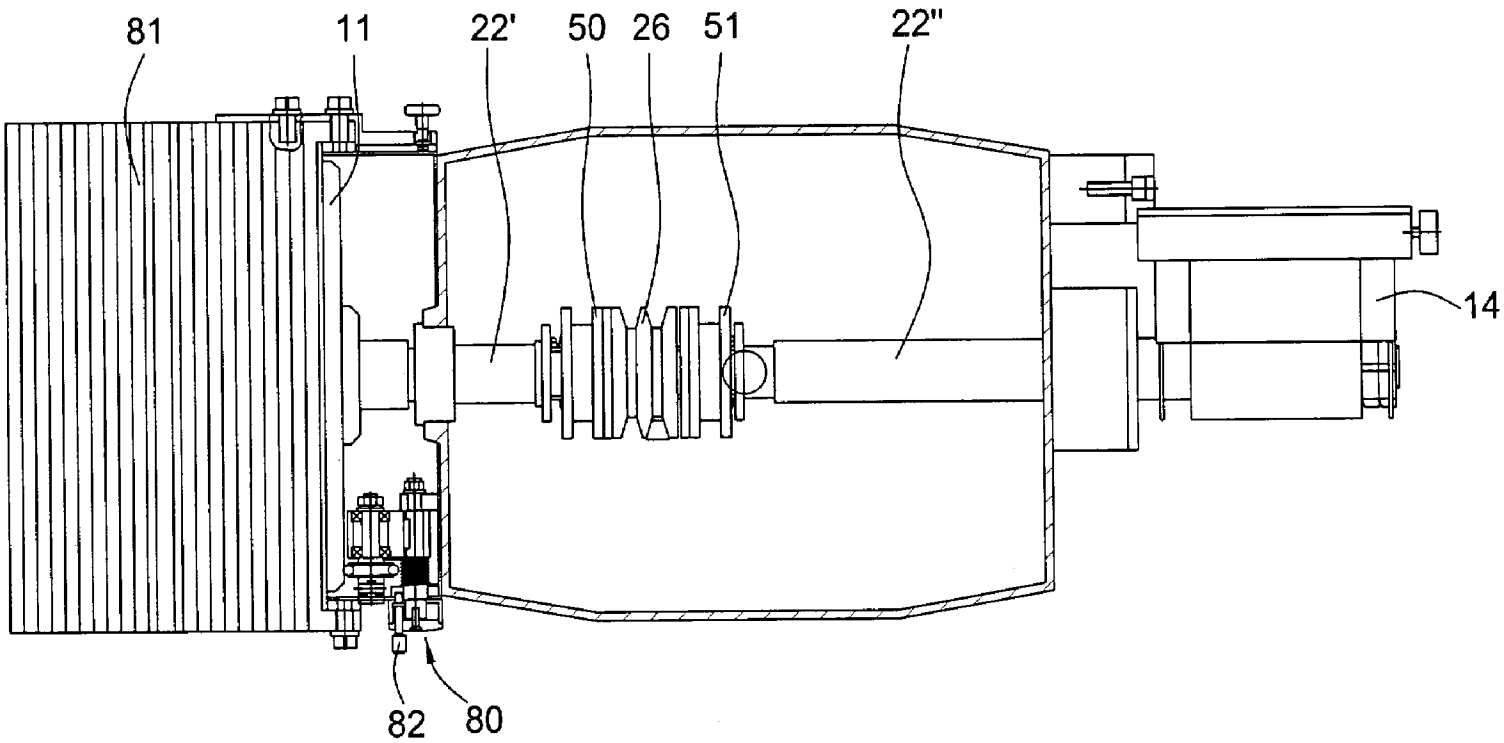

FIG. 7 is top schematic view of the rotary shafts 22' and 22" according to one embodiment of the present invention. As shown in FIG. 7, the rotary disk tool 11 includes a flexible shaft apparatus 80. The flexible shaft apparatus 80 serves to increase the rotational velocity of the rotary tool 11 by means well known to a person of ordinary skill in the art. A handle 82 is used to actuate the flexible shaft apparatus 80. The flex shaft apparatus 80 is shown in communication with the rotary tool 11; however, it is assumed that a flexible shaft apparatus can be placed in communication with any of the rotary disk tools disposed on the multi-station tool 3. FIG. 7 also shows a work table disposed below the rotary tool 11 to provide support to an object (not shown) during operation.

While the foregoing is directed to embodiments of the present invention, other and further embodiments of the invention may be devised without departing from the basic scope thereof, and the scope thereof is determined by the claims that follow.

The invention claimed is:

1. A multi-station tool comprising:

a support structure;

a plurality of out-drives supported on the support structure so that the out-drives may rotate relative to the support structure;

a drive motor supported on the support structure;

a plurality of pulleys, each of the pulleys selectively rotationally coupled to at least one of the out-drives;

a plurality of transmission links rotationally coupling, directly or indirectly, each of the pulleys to the drive motor; and at least one control member which selectively rotationally couples at least one of the pulleys to at least one of the out-drives, wherein the control member provides a visual indication of whether the pulley is rotationally coupled to the out-drive.

2. The multi-station tool of claim 1, wherein the support structure comprises at least one selectively lockable wheel and at least one tool drawer.

3. The multi-station tool of claim 1, wherein the drive motor has an output shaft which can selectively rotate in two directions.

4. The multi-station tool of claim 1, further comprising a power switch for supplying power to the drive motor, the power switch including an interlock which locks the control member when the power switch is on.

5. The multi-station tool of claim 1, wherein a rotational speed of at least one of the out-drives differs from a rotational speed of at least one other of the out-drives.

6. The multi-station tool of claim 1, wherein each of the out-drives is selectively rotationally coupled to the drive motor.

7. The multi-station tool of claim 6, wherein a selection of one of the out-drives for rotational coupling to the drive motor results in an rotational uncoupling of all other out-drives from the drive motor.

8. The multi-station tool of claim 1, wherein the selective rotational coupling is facilitated by a clutch.

9. The multi-station tool of claim 8, wherein the clutch is a selective slip clutch.

10. The multi-station tool of claim 9, wherein a clutch slip torque is selected such that to be greater than a drive motor overload torque.

11. The multi-station tool of claim 9, wherein a clutch slip torque is selected to be less than a drive motor overload torque.

12. The multi-station tool of claim 1, wherein a rotating speed of at least one of the out-drives is adjustable relative to a constant drive motor speed.

13. The multi-station tool of claim 1, wherein at least one of the out-drives includes an abrasive tool attached thereto.

14. The multi-station tool of claim 1, wherein at least one of the out-drives is operatively connected to a belt tool.

15. The multi-station tool of claim 14, wherein the belt tool comprises a body which is pivotal about an axis of the out-drive connected to the belt tool.

16. The multi-station tool of claim 1, wherein at least one of the out-drives is operatively connected to a flexible shaft.

17. The multi-station tool of claim 1, wherein:

the plurality of out-drives have rotating abrasive tools attached thereto; and a rotating speed of at least one of the out-drives is adjustable relative to a constant drive motor output speed.

18. A multi-station tool comprising:

a plurality of rotating out-drives;

a drive motor;

a power transfer system, the power transfer system delivering power to the plurality of rotating out-drives and including:

a plurality of pulleys, wherein each pulley is disposed on at least one rotating out-drive; and a plurality of transmission links, wherein the plurality of transmission links places each pulley in communication with the drive motor and at least one other pulley; and an out-drive selecting system, including:

a plurality of clutches, wherein each clutch is secured on one rotating out-drive and engaged to one pulley;

a plurality of cam followers;

one or more control shafts; and a plurality of cams disposed on the one or more control shafts and in communication with the plurality of cam followers, wherein rotation of the one or more control shafts orients the cams to pivot one or more of the plurality of cam followers to engage or disengage the plurality of clutches from their respective pulley.

19. The multi-station tool of claim 18, wherein rotation of the one or more control shafts results in a visual indication of the selected out-drive.

20. The multi-station tool of claim 18, wherein at least one of the out-drives is selectively operationally disconnected from the drive motor while at least one other of the out-drives remains operationally connected to the drive motor.

21. The multi-station tool of claim 18, wherein selecting one out-drive for operational connection to the drive motor results in an operational disconnection of all other out-drives from the drive motor.

22. The multi-station tool of claim 18, wherein the drive motor is disposed on an elevation mechanism that serves to adjust the tension of at least one transmission link.

23. The multi-station tool of claim 18, wherein at least one out-drive is operatively connected to a flexible shaft.

24. A method for selectively operating a multi-station tool comprising:

providing a first and second rotary out-drive to the multi-station tool, wherein each of the first and second rotary drives is engaged to a first and second clutch, respectively;

rotating one or more control shafts whereby a plurality of cams disposed on the one or more control shafts are correspondingly rotated to selectively pivot a plurality of cam followers in communication with the first and second clutch;

disengaging the first clutch from the first rotary out-drive; and delivering power from a drive motor to a plurality of pulleys through a plurality of transmission links to actuate the second out-drive, wherein at least one pulley is in rotational communication with the second out-drive.

25. The method of claim 24, wherein disengaging the first clutch from the first rotary out-drive comprises pivoting at least one of the plurality of cam followers.

26. A multi-station tool comprising:

a support structure;

a tool supported on the support structure, the tool having a plurality of rotating out-drives;

a drive motor supported on the support structure, the drive motor selectively driving the plurality of out-drives, wherein a driven out-drive selection results in a visual indication of the selected out-drive; and a power switch for supplying power to the drive motor, the power switch including an interlock which locks the driven out-drive selection when the power switch is on.

27. A multi-station tool comprising:

a support structure;

a tool supported on the support structure, the tool having a plurality of rotating out-drives; and a drive motor supported on the support structure, the drive motor selectively driving the plurality of out-drives, wherein:

at least one out-drive is operatively connected to a belt tool, and the belt tool comprises a body which is pivotal about an axis of the out-drive connected to the belt tool.

28. A multi-station tool comprising:

a support structure;

an out-drive supported on the support structure so that the out-drive may rotate relative to the support structure;

a drive motor supported on the support structure;

a pulley selectively rotationally coupled to the out-drive;

a transmission link rotationally coupling the pulley to the drive motor; and a control member which selectively rotationally couples the pulley to the out-drive, wherein the control member provides a visual indication of whether the pulley is rotationally coupled to the out-drive.

29. The multi-station tool of claim 28, further comprising a power switch for supplying power to the drive motor, the power switch including an interlock which locks the control member when the power switch is on.

30. A multi-station tool comprising:

a support structure;

an out-drive supported on the support structure so that the out-drive may rotate relative to the support structure, wherein the out-drive is operatively connected to a flexible shaft;

a drive motor supported on the support structure;

a pulley selectively rotationally coupled to the out-drive; and a transmission link rotationally coupling the pulley to the drive motor.

31. A multi-station tool comprising:

a support structure;

a plurality of out-drives supported on the support structure so that the out-drives may rotate relative to the support structure;

a drive motor supported on the support structure;

a plurality of pulleys, each of the pulleys selectively rotationally coupled to at least one of the out-drives; and a plurality of transmission links rotationally coupling, directly or indirectly, each of the pulleys to the drive motor, wherein:

at least one of the out-drives is operatively connected to a belt tool, and the belt tool comprises a body which is pivotal about an axis of the out-drive connected to the belt tool.

32. A multi-station tool comprising:

a support structure;

a plurality of out-drives supported on the support structure so that the out-drives may rotate relative to the support structure;

a drive motor supported on the support structure;

a plurality of pulleys, each of the pulleys selectively rotationally coupled to at least one of the out-drives; and a plurality of transmission links rotationally coupling, directly or indirectly, each of the pulleys to the drive motor, wherein at least one of the out-drives is operatively connected to a flexible shaft.

* * * * *